US008733333B2

(12) United States Patent
Barrios

(10) Patent No.: US 8,733,333 B2
(45) Date of Patent: May 27, 2014

(54) CAM ACCESSIBLE PORTABLE BOW PRESS

(76) Inventor: Anthony Barrios, Tucson, AZ (US)

( * ) Notice: Subject to any disclaimer, the term of this patent is extended or adjusted under 35 U.S.C. 154(b) by 142 days.

(21) Appl. No.: 13/573,352

(22) Filed: Sep. 11, 2012

(65) Prior Publication Data

US 2014/0069407 A1 Mar. 13, 2014

(51) Int. Cl.
*F41B 5/14* (2006.01)

(52) U.S. Cl.
USPC ..... 124/1; 124/86

(58) Field of Classification Search
CPC ..... F41B 5/1449
USPC ..... 124/1, 80, 86
See application file for complete search history.

(56) References Cited

U.S. PATENT DOCUMENTS

| | | | | |
|---|---|---|---|---|
| 5,222,473 | A * | 6/1993 | Lint | 124/86 |
| 5,425,350 | A * | 6/1995 | Egusquiza | 124/86 |
| 7,089,923 | B2 * | 8/2006 | Johnson | 124/1 |
| 7,913,680 | B2 * | 3/2011 | Evans | 124/86 |
| 7,980,235 | B1 * | 7/2011 | Kronengold et al. | 124/1 |

* cited by examiner

*Primary Examiner* — John Ricci

(57) ABSTRACT

A cam accessible portable bow press is comprised of a pair of press arm, each press arm further comprising a pair of press levers, each press lever comprising a limb lever adapted to be adjustably disposed between a bow's riser and one of the bow's cams and a cam lever adapted to substantially enclosed the outer circumference of a cam without obstructing access to the side of each cam. The press arms are tensioned using a combination of straps and buckles, allowing the user to compress the bow's limbs to aid in stringing or unstringing the bow or to perform maintenance on the bow's cams without to unstringing the bow.

4 Claims, 4 Drawing Sheets

CAM ACCESSIBLE PORTABLE BOW PRESS

BACKGROUND OF THE INVENTION

1. Field of the Invention

The present invention relates to a bow press. More specifically, the invention relates to cam accessible portable bow press that allows a user to easily string a bow or perform maintenance on the bow's cams.

2. Description of the Prior Art

Without a bow press, it can be extremely difficult to string a bow and, once the bow is strung, to perform maintenance on the bow's cams without unstringing the bow. Until now, a user would have to trade the full functionality of a large, semi-stationary bow press with the ease and transportability of a portable bow press. Additionally, most portable bow presses interfere with access to a bow's cams from the sides when the bow press is engaged.

SUMMARY OF THE INVENTION

The present invention overcomes the disadvantages and limitations of the prior arts by providing the robust functionality of a large, semi-stationary bow press with the ease and transportability of a portable bow press. The present invention is substantially a pair of press arms each comprised of a pair of press levers which are, in turn, comprised of cam levers and limb levers. Each pair of press levers is connected by bolts or quick-release pins which allow the press arms to be placed strategically around the upper and lower limbs of a bow. The press arms are connected to each other via a tensioning device comprising one or more straps and one or more buckles to allow the user to place tension on the strap(s), thus drawing the press arms closer together. By placing the limb levers between the bow's pivot points and cams and by placing the cam levers around the circumference of each cam, the user can draw the bow's limbs together, safely and effectively, thus allowing the user to string or unstring the bow and to perform maintenance on the bow's cams from either side without unstringing the bow.

Various other purposes and advantages of the invention will become clear from its description in the specification that follows and from the novel features particularly pointed out in the appended claims. Therefore, this invention comprises the features hereinafter illustrated in the drawings, fully described in the detailed description of the preferred embodiments, and particularly pointed out in the claims. However, such drawings and description, as well as this Summary of the Invention, disclose just a few of the various ways in which the invention may be practiced and are not limiting on the invention.

DESCRIPTION OF THE INVENTION

The present invention overcomes the disadvantages and limitations of the prior art by providing a means of compressing the limbs of a bow, allowing the different cams of the bow to come closer together, thus allowing a user to easily install or remove the bowstrings. The primary advantage of the instant invention is that the shape of the press levers allows easy and unobstructed access to the bow's cams while exerting maximum leverage at the pivot point of each bow limb.

Figure 1:
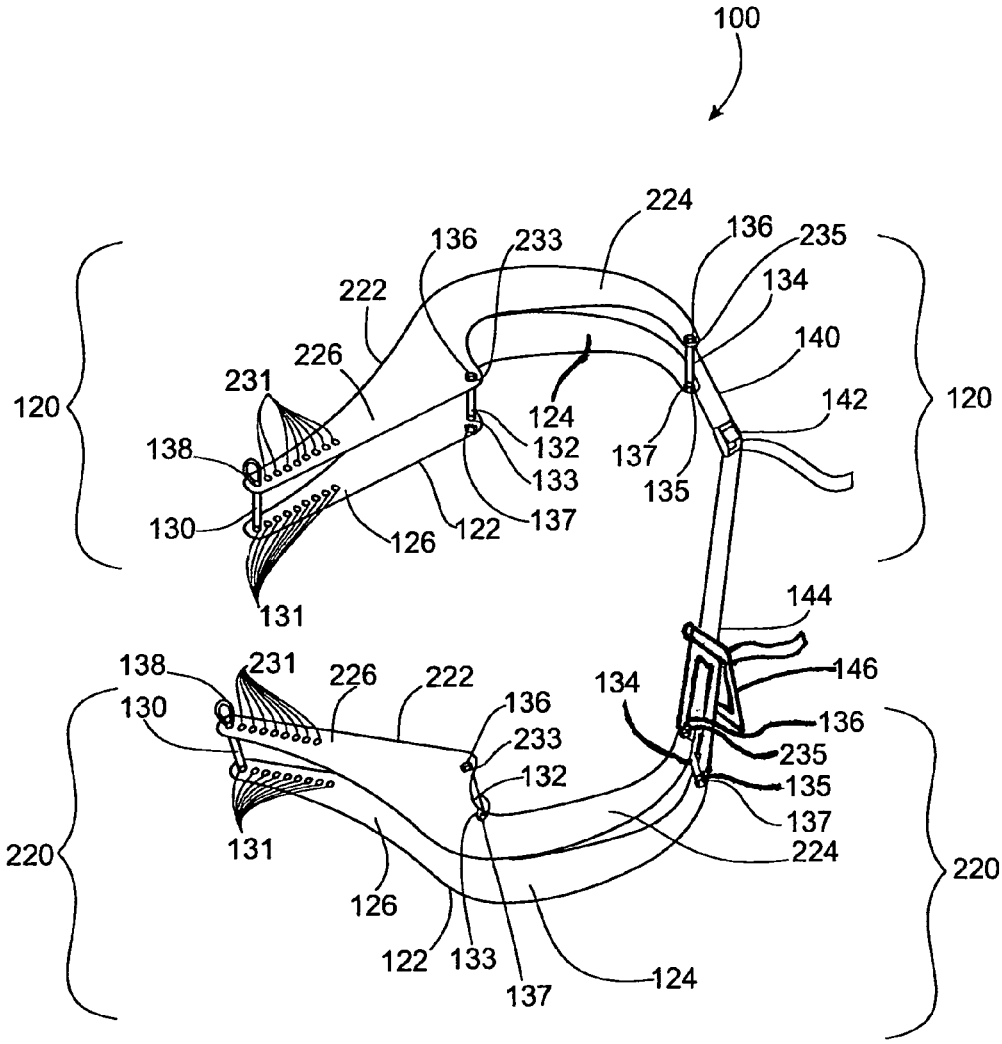
FIG. 1 is an illustration of an cam accessible portable bow press, according to the invention, that includes a top press arm and a bottom press arm, each press arm comprising an upper press lever and a lower press lever, each press lever further comprising a cam lever and a limb lever, and the top press arm being connected to the bottom press arm by a tensioning device.

Referring to the figures, wherein like parts are designated with like reference numerals and symbols, FIG. 1 is an illustration of a Portable Bow Press 100, according to the invention that includes a top press arm 120 comprising a lower press lever 122 and an upper press lever 222 and a bottom press arm 220 also comprising a lower press lever 122 and an upper press lever 222. Each lower press lever 122 comprises a lower cam lever 124 and lower limb lever 126. Likewise, each upper press lever 222 comprises an upper cam lever 224 and an upper limb lever 226.

Each lower press lever 122 is connected to an upper press lever 222 via (a) a quick release pin 138 inserted through one of a plethora of lower adjustment holes 131 located along the lower limb lever 126, through an adjustable tube spacer 130, and through one of a plethora of upper adjustment holes 231 located along the upper limb lever 226; (b) a bolt 136 or similar device inserted through a lower cam hole 133, through an affixed tube spacer 132, and through an upper cam hole 233; and (c) a bolt 136 or similar device inserted through a lower connecting hole 135, through a split-sleeve spacer 134, and through an upper connecting hole 235. Alternatively, the affixed tuber spacer 132 and the split-sleeve spacer 134 may each be replaced with a bushing. The bolts 136 are secured via nuts 137. Alternatively, the bolts 136 could be secured via cotter pins, to allow quick assembly and disassembly.

The top press arm 120 is connected to the bottom press arm 220 by way of long strap 144 connected to the split-sleeve spacer 134 of the bottom press arm 220 by a ratchet buckle 146 on one end of the long strap 144 and to the split-sleeve spacer 134 of the top press arm 120 by a short strap 140 comprising a cam buckle 142 on the other end of the long strap 144.

Figure 2:
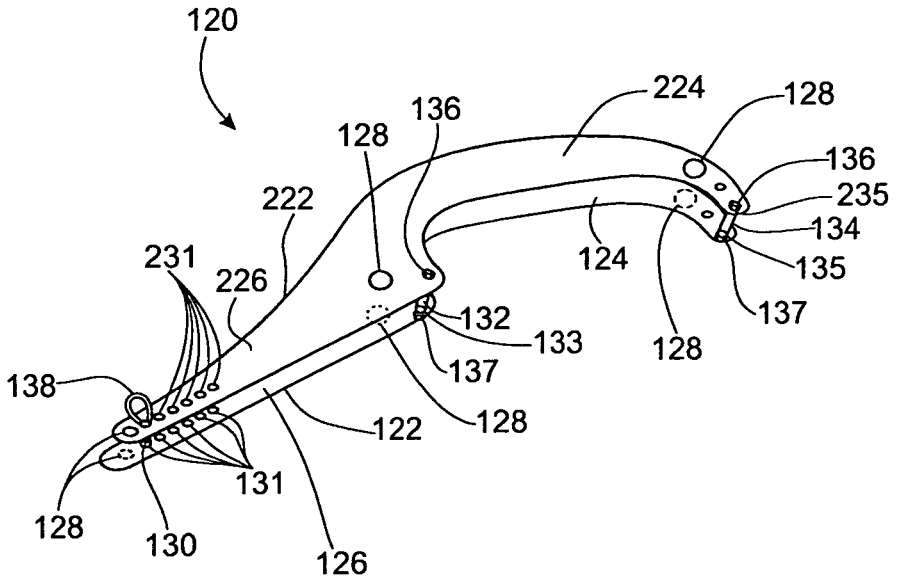
FIG. 2 is an illustration of the top press arm illustrated in FIG. 1.

FIG. 2 illustrates the top press arm 120, as previous illustrated in FIG. 1, comprising both a lower press lever 122 and an upper press lever 222. In this embodiment of the invention, the bottom press arm 220 is identical to the top press arm 120. Stemmed bumpers 128 are placed along the exterior surfaces of the lower press lever 122 and the upper press lever 222.

Figure 3:
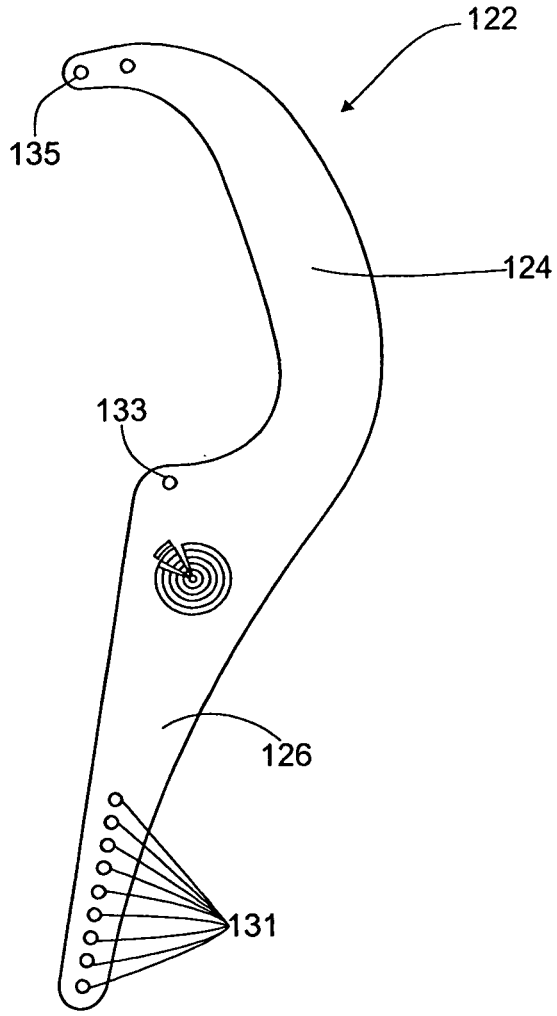
FIG. 3 is an illustration of the lower press lever illustrated in FIGS. 2 and 3.

FIG. 3 illustrates the lower press lever 122, as previously illustrated in FIG. 1, comprising the lower cam lever 124, the lower limb lever 126, the plethora of lower adjustment holes 131, the lower cam hole 133, and the lower connecting hole 135. In this embodiment of the invention, the upper press lever 222 is identical to the lower press lever 122, also comprising an upper cam lever 224, an upper limb lever 226, the plethora of upper adjustment hole 231, the upper cam hole 233, and the upper connecting hole 235.

Figure 4:
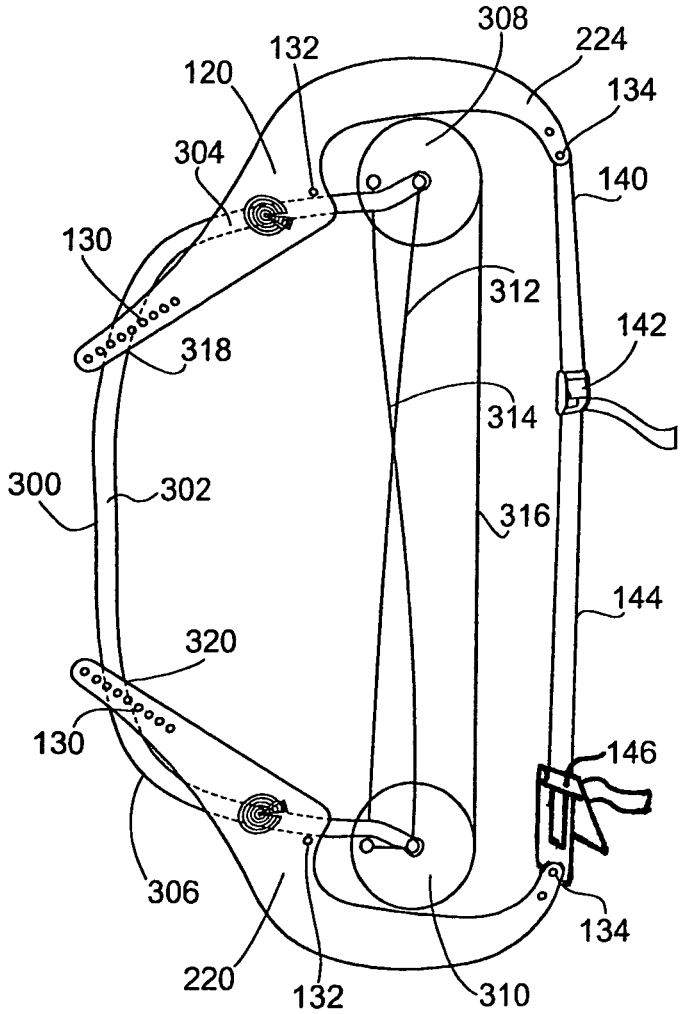
FIG. 4 is an illustration of the cam accessible portable bow press strategically placed around a bow so that each press arm, when tensioned by the tensioning device, compresses a limb of the bow safely and efficiently at one of the bow's pivot points, allowing a user to easily string or unstring the bow or perform maintenance of the bow's cams without unstringing the bow.

FIG. 4 illustrates the portable press bow 100 illustrated in FIG. 1 placed onto an archery bow 300. The archery bow 300 comprises a riser 302, an upper limb 304, a lower limb 306, an upper cam 308, a lower cam 310, a first cable 312 stretching from the upper cam 308 to the lower cam 310, and a second cable 314 stretching from the lower cam 310 to the upper cam 308. The riser 302 and the upper limb 304 form an upper interior curve centered at an upper pivot point 318. Likewise, the riser 302 and the lower limb 306 form a lower interior curve centered at a lower pivot point 320. A draw string 316 stretches from the upper cam 308 to the lower cam 310.

The portable bow press 100 is placed on the archery bow 300 so that the top press arm 120 encapsulates the upper limb 304 and the bottom press arm 220 encapsulates the lower limb 306.

The top press arm 120 is positioned so that lower cam lever 124 and the upper cam lever 224 of the top press arm 120 are disposed around the upper cam 308, leaving it unobstructed from the sides. The affixed tube spacer 132 is positioned along the outer surface of the upper limb 304 near the upper cam 308 to assist in providing leverage.

The quick release pin 138 of the top press arm 120 is disposed through one of the lower adjustment holes 131 of the lower limb lever 126 of the lower press lever 122 and a corresponding one of the upper adjustment holes 231 of the upper limb lever 226 of the upper press lever 222 so that the adjustable tube spacer 130 is located at the upper pivot point 318 along the upper interior curve formed by the riser 302 and the upper limb 304.

The combination of the affixed-tube spacer 132 being disposed next to the upper cam 308 and along the outer surface of the upper limb 304 coupled with the adjustable tube spacer 130 being located at the upper pivot point 318 along the upper interior curve allows the top press arm 120 to exert maximum leverage on the upper limb 304 while reducing the potential for damaging the upper limb 304.

The bottom press arm 220 is positioned so that lower cam lever 124 and the upper cam lever 224 of the bottom press arm 220 are disposed around the lower cam 310, leaving it unobstructed from the sides. The affixed tube spacer 132 is positioned along the outer surface of the lower limb 306 near the lower cam 310 to assist in providing leverage.

The quick release pin 138 of the bottom press arm 220 is disposed through one of the lower adjustment holes 131 of the lower limb lever 126 of the lower press lever 122 and a corresponding one of the upper adjustment holes 231 of the upper limb lever 226 of the upper press lever 222 so that the adjustable tube spacer 130 is located at the lower pivot point 320 along the lower interior curve formed by the riser 302 and the lower limb 306.

The combination of the affixed tube spacer 132 being disposed next to the lower cam 310 and along the outer surface of the lower limb 306 coupled with the adjustable tube spacer 130 being located at the lower pivot point 320 along the lower interior curve allows the bottom press arm 220 to exert maximum leverage on the lower limb 306 while reducing the potential for damaging the lower limb 306.

The combination of the short strap 140, the cam buckle 142, the long strap 144, and the ratchet buckle 146 connected to the split-sleeve spacer 134 of the top press 120 arm to the split-sleeve spacer 134 of the bottom press arm 220 allows the top press arm 120 to exert leverage on the upper limb 304 and the bottom press arm 220 to exert leverage on the bottom limb 306. The cam buckle 142 is used to provide slight tension on the straps 140, 144 and press arms 120, 220 so that the bow 300 may be positioned without the portable bow press 100 falling off or falling out of position. Once the user is satisfied with the position of the top press arm 120 and the bottom press arm 220, the ratchet buckle 146 may be used to provide additional tension to the straps 140, 144 and the press arms 120, 220. The tension provided by the ratchet buckle 146 can be adjusted so that the draw string 316 is loose or so that adjustment or maintenance may be performed on the cams 308, 310.

I claim:

1. A cam accessible portable bow press for a bow comprising a riser, an upper limb having an inner curved surface and an outer curved surface, an upper pivot point disposed between the riser and the upper limb, an upper cam disposed at an outer end of the upper limb, and a lower limb having an inner curved surface and an outer curved surface, a lower pivot point disposed between the riser and the lower limb, a lower cam disposed at an outer end of the lower limb, and a draw string, the cam accessible portable bow press comprising:

a top press arm comprising a lower press lever including a lower cam lever and a lower limb lever and an upper press lever including an upper cam lever and an upper limb lever, the lower press lever being joined to the upper press lever by a pin disposed on an outer end of each limb lever, a first bolt disposed on an outer end of each cam lever, and a second bolt disposed approximately at a junction of each limb lever to each corresponding cam lever, each limb lever adapted to adjustably reside between the bow's riser and one of the bow's cams and each cam lever adapted to substantially enclose a circumference of the bow's upper cam without obstructing each side of the upper cam;

a bottom press arm also comprising a lower press lever also including a lower cam lever and a lower limb lever and an upper press lever also including an upper cam lever and an upper limb lever, the lower press lever being joined to the upper press lever by a pin disposed on an outer end of each limb lever, a first bolt disposed on an outer end of each cam lever, and a second bolt disposed approximately at a junction of each limb lever to each corresponding cam lever, each limb lever adapted to adjustably reside between the bow's riser and one of the bow's cams and each cam lever adapted to substantially enclose a circumference of the bow's lower cam without obstructing each side of the lower cam; and a tensioning device disposed between the first bolt of the top press arm and the first bolt of the bottom press arm, whereby the pin of the top press arm is adapted to be placed on the interior curved surface of the bow's upper limb at the upper pivot point and the second bolt of the top press arm is adapted to be placed on the outer curved surface of the bow's upper limb near the upper cam, the pin of the bottom press arm is adapted to be placed on the interior curved surface of the bow's lower limb at the lower pivot point and the second bolt of the bottom press arm is adapted to be placed on the outer curved surface of the bow's lower limb near the lower cam, and said tensioning device is adapted to draw the cam levers of the top press arm closer to the cam levers of the bottom press arm thus compressing the bow's upper limb and lower limb at the upper pivot point and lower pivot point, respectively, and each cam lever of each press lever of each press arm are adapted to allow unobstructed access to sides of the bow's upper cam and lower cam.

2. The cam accessible portable bow press of claim 1, wherein the tensioning device comprises a ratchet buckle connected to the first bolt of the bottom press arm, a long strap connected to the ratchet buckle on one end, a cam buckle connected to the long strap on a second end, and a short strap connected on a first end to the cam buckle and on another end to the first bolt of the top press arm.

3. The cam accessible portable bow press of claim 1, wherein each press lever comprises a stemmed bumper.

4. The cam accessible portable bow press of claim 1, wherein each limb lever comprises a plethora of adjustment holes adapted to allow the pin of each press arm to be adjustably placed near its corresponding pivot point.

* * * * *